US006430297B1

(12) United States Patent
Nakamura

(10) Patent No.: US 6,430,297 B1
(45) Date of Patent: Aug. 6, 2002

(54) SPEAKER AND SPEAKER DEVICE

(75) Inventor: Takeshi Nakamura, Kyoto-fu (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/390,205

(22) Filed: Sep. 7, 1999

(30) Foreign Application Priority Data

Sep. 28, 1998 (JP) ..... 10-273027
Sep. 28, 1998 (JP) ..... 10-273028

(51) Int. Cl.[7] ..... H04R 25/00

(52) U.S. Cl. ..... 381/345; 381/351; 381/161; 381/162; 181/148; 181/149; 181/182

(58) Field of Search ..... 381/337–339, 381/345–351, 161, 140, 141, 146, 353, 348, 397, 332, 335, 386; 181/182, 184, 189, 198, 156, 185, 186, 187, 196, 199

(56) References Cited

U.S. PATENT DOCUMENTS 3,727,719 A * 4/1973 Yando
4,875,546 A * 10/1989 Krnan
4,942,939 A * 7/1990 Harrison
5,025,885 A * 6/1991 Froeschle

FOREIGN PATENT DOCUMENTS

| | | |
|---|---|---|
| DE | 1064988 | * 12/1956 |
| JP | 52-8426 | 5/1975 |
| JP | 6-58689 | 12/1994 |

* cited by examiner

*Primary Examiner*—Binh Tieu
*Assistant Examiner*—Dionne N. Harvey
(74) *Attorney, Agent, or Firm*—Keating & Bennett, LLP

(57) ABSTRACT

A speaker has a very small size and is arranged to emit sound waves in a non-directional manner. The speaker includes a case and a speaker unit attached to a plate provided at an opening of the case. The speaker is arranged so that the speaker unit is mounted or attached to a floor or support surface such that a space formed by the case, the plate and the speaker unit is airtight and so that the back-and-forth motion of a vibrator of the speaker unit generates expansion and contraction of the case.

20 Claims, 6 Drawing Sheets

SPEAKER AND SPEAKER DEVICE

BACKGROUND OF THE INVENTION

1. Field of the Invention

The present invention relates to a speaker, and more particularly, to a speaker for generating low-frequency sounds which may be used, for instance, as a woofer or other component in a 3D sound system. Furthermore, the present invention relates to a speaker device, and more particularly, to a speaker device including an amplifier and a speaker unit contained in a single case.

2. Description of the Related Art

A bookshelf-type speaker is generally used as a conventional speaker. This speaker includes a dynamic speaker unit provided in a case, and sound is emitted from the front surface of the speaker unit. Sound is generated by the vibrations of a vibrating plate of the speaker unit. The sound generated is emitted not only from the front surface of the vibrating plate but also from a rear side thereof. Since the sound emitted from the front surface of the speaker unit and the sound emitted from the rear side have opposite phases relative to each other, the case in which the speaker is provided cuts off the sound emitted from the rear side of the speaker unit so that the sound waves emitted from the front surface and the sound waves emitted from the rear side do not cancel each other.

However, the sound emitted from the rear side of the speaker unit makes the case vibrate. Such vibration of the case is reduced by using a highly rigid material to construct the case, using reinforcing material to restrict the vibration of the case, and inserting sound-absorbing material inside of the case. As a result, vibration of the case is reduced and the sound emitted from the rear side of the speaker unit is cut off sufficiently, so that only the sound emitted from the front surface of the speaker unit is transmitted to outside of the case.

When this sort of bookshelf speaker is used to manufacture a speaker for generating low-frequency sounds such as a woofer, a large-scale speaker unit is required. Furthermore, to obtain a sufficiently low tone, a large-volume case must be provided. Moreover, since sound emitted from the front surface of the speaker unit is used, the sound obtained has directivity.

As shown in FIG. 12, another conventional audio device relevant to the background of the present invention includes an amplifier provided inside of the case of a speaker. The audio device 1 includes a speaker unit 3 attached to the front surface of a case 2. In addition, a partitioning board 4 is arranged to partition a portion of the inside of the case 2, and an amplifier 5 is attached in the portion partitioned by the partitioning board 4. A through hole 6 is provided in the partitioning board 4, and a distribution hole 6 is provided in the case 2.

In the audio device 1, the amplifier 5 amplifies an input signal and the amplified signal vibrates the vibrator of the speaker unit 3, whereby sound is emitted from the front surface of the speaker unit 3. Further, when the vibrator of the speaker unit 3 vibrates, air inside of the case 2 flows through the through hole 6 in the partitioning board 4 and through the distribution hole of the case 2. This flow of air cools the amplifier 5.

However, since this type of audio device uses sound emitted from the front surface of the speaker unit, the sound which is generated by this audio device has directivity. Furthermore, since the sound emitted from the rear side of the speaker is opposite in phase to the sound emitted from the front surface of the speaker unit, it is necessary to prevent these sounds from cancelling each other. Consequently, it is necessary to cut off sound emitted from the rear side of the speaker unit, and to restrict vibration of the case by reinforcing the case, inserting sound-absorbing material, and taking other corrective measures. More specifically, a speaker for producing low-frequency tones, such as a woofer, has a large speaker unit and therefore requires a large-volume case. When such a large case is used, and an amplifier is provided inside of the case, the large size of the speaker and the corresponding large volume of the case make it difficult to reduce the size of the whole structure.

SUMMARY OF THE INVENTION

In order to overcome the problems described above, preferred embodiments of the present invention provide a speaker and a speaker device which have a greatly reduced size and emit sound waves in a non-directional manner.

A speaker according to preferred embodiments of the present invention includes a speaker unit and a case attached to the speaker unit, and the speaker unit being arranged to emit sounds to outside of the case as a result of the case vibrating in response to vibration of the speaker unit.

In such a speaker, the speaker unit is arranged inside of the case so that when the case is mounted on a support or mounting surface, the speaker unit faces toward the support or mounting surface on which the case is supported or installed.

Preferably, a space inside of the case defined by the speaker unit and the inner surfaces of the case, is airtight.

In addition, a port may be provided on the bottom surface of the case located at the surface closest to the location of the support or mounting surface.

Preferably, the inner portion of the case does not have a structure which would restrict the vibration of the case.

The back-and-forth vibration of the vibrator of the speaker unit causes the case to vibrate in an expanding and contracting motion. As a result of this expansion and contraction of the case, non-directional spherical waves are emitted to areas outside of the case. The expansion and contraction of the case caused by the back-and-forth vibration of the speaker unit is generated when pressure, created by the vibration of the speaker unit, is transmitted to the air inside of the case, whereby the pressure is transferred to the case. Therefore, in order to make the case expand and contract effectively, the case should preferably have small volume, enabling the speaker to have a very small size.

Preferably, the speaker unit faces the airtight space inside of the case in order to make the case expand and contract effectively. By storing the speaker unit inside of a very small case, the resonant frequency of the speaker is significantly increased, enabling the fidelity of the speaker to be improved by generating sound at frequencies below the resonant frequency.

By providing the speaker unit on a floor side of the case, it is possible to cut off sound emitted from the speaker unit to the outside thereof, so that only sound generated by the expansion and contraction of the case is emitted.

Furthermore, a port may be provided at the bottom portion of the case to accentuate low-frequency tones, so that the low-frequency sound emitted from the speaker unit toward the floor exits through the port.

A speaker device according to a preferred embodiment of the present invention includes a case, an amplifier main body stored inside of the case, and a speaker unit stored inside the case, the amplifier main body being provided in front of the speaker unit.

In such a speaker device, the amplifier main body is provided on the support or mounting surface side of the case, and the speaker unit is arranged so as to face toward the installation surface and so as to emit sound through the amplifier main body.

Furthermore, a gap may be provided between the inner wall of the case and the amplifier main body. As a result of this arrangement, the vibrations of the speaker unit send air through the gap, thereby cooling the amplifier main body. In addition, the gap is used as a load horn which makes is arranged to cause sound emitted from the speaker unit to pass through the load horn.

Furthermore, the case vibrates by being vibrated by vibration of the speaker unit, thereby emitting sound to the outside of the case due vibration of the case.

It is preferable that the inner portion of the case does not have a structure which would restrict the expansion and contraction of the case.

Inside of the case, the amplifier main body is preferably provided in front of the speaker unit, so that sound emitted from the front surface of the speaker unit is emitted into the space where the amplifier main body is provided. At this point, the weight of the amplifier main body restricts unwanted vibrations, preventing the sound from reaching to the outside of the case. Then, sound emitted from the rear side of the speaker unit expands and contracts the case, and the expansion and contraction of the case emits sound to the outside of the case. The expansion and contraction of the case is excited when pressure, generated by the vibration of the speaker unit, is transmitted to the air inside of the case, whereby the pressure is transferred to the case. Therefore, in order to make the case expand and contract effectively, the case should preferably have very small volume, thereby enabling the speaker to have a very small size.

Thus, by utilizing the expansion and contraction of the case, caused by the vibration of the speaker unit, the overall size of the speaker is significantly reduced. Consequently, even when the amplifier has a small case, a speaker including the speaker unit and the amplifier case can be obtained by expanding and contracting the case using the vibration of the speaker unit.

In this type of speaker device, the speaker unit is preferably arranged so that it faces toward the floor or mounting surface so as to use the expansion and contraction of the case. That is, the case of the speaker device is provided so that the amplifier faces the floor or mounting surface and is located closest to floor or mounting surface as compared to the speaker unit.

Furthermore, when a gap is provided between the inner walls of the case and the amplifier main body, the vibration of the speaker unit forces air through the gap, and this flow of air cools the amplifier main body. In addition, sound emitted from the front surface of the speaker unit passes through the gap, which thereby functions as a load horn to accentuate the low tones.

These and other objects, features and advantages of the present invention will become clearer when the following detailed description of preferred embodiments is read in conjunction with the accompanying drawings.

DETAILED DESCRIPTION OF THE PREFERRED EMBODIMENTS

Figure 1:
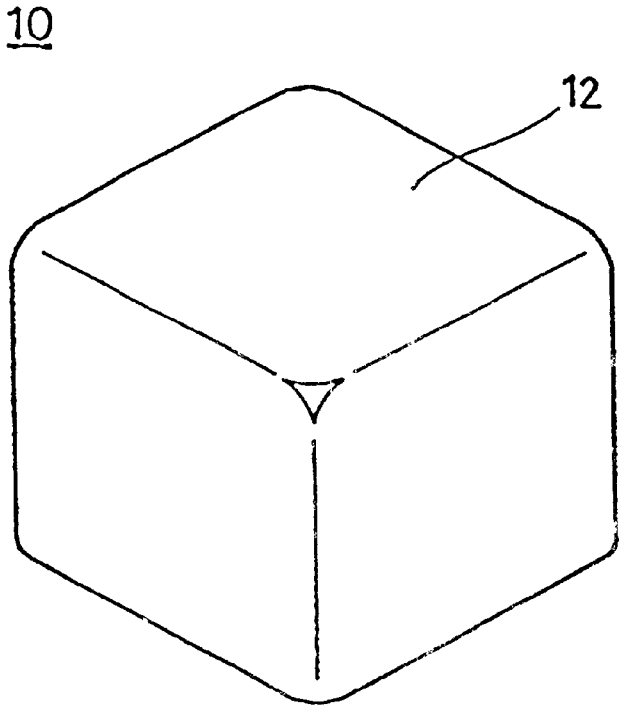
FIG. 1 is a perspective view of an example of a preferred embodiment of a speaker of the present invention.

FIG. 1 is a perspective view of an example of the speaker of preferred embodiments of the present invention. The speaker 10 preferably includes a case 12 having an opening at one side thereof. The case 12 can have an approximately cubic shape.

In the speaker 10 shown in FIG. 1, the case 12 is not a perfect cube. Instead, the edge portions of the cube are rounded so that the intersections between all of the flat surfaces are curved. The case 12 may be made of wood, plastic, or other suitable material, for instance.

Figure 2:
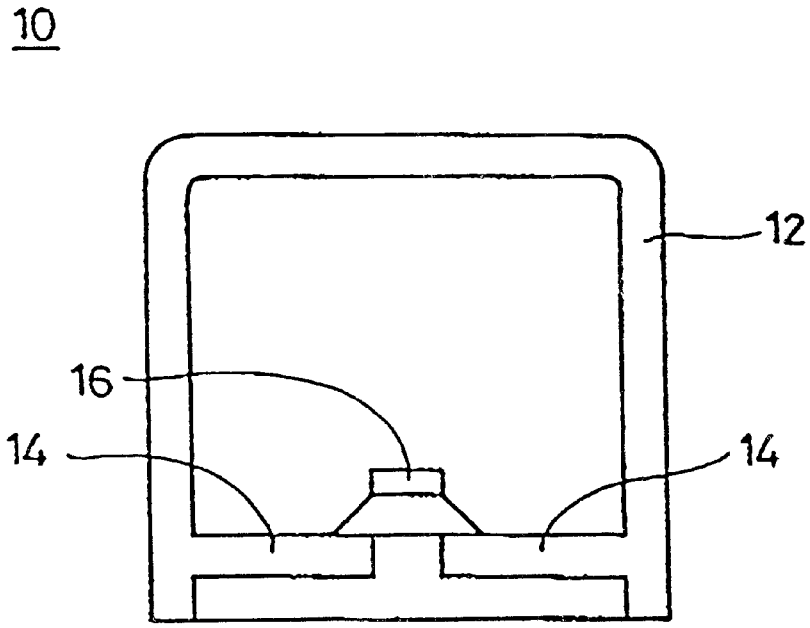
FIG. 2 is a cross-sectional diagrammatic view of the speaker of FIG. 1.

As shown in FIG. 2, a plate 14 has a through hole formed therein, preferably at the approximate center thereof and is provided at the opening of the case 12. A speaker unit 16 is mounted at the through hole portion at the approximate center of the plate 14. A dynamic speaker unit can, for instance, be used as the speaker unit 16. In this case, the speaker unit 16 is attached to the plate 14 in such a manner that the front surface of the speaker unit 16 faces toward the outside of the case 12. That is, the speaker unit 16 is arranged to fire sound waves toward the through hole and toward the surface upon which the speaker is mounted. The space defined by the case 12, the plate 14 and the speaker unit 16 is airtight so that the sound waves emitted from the speaker unit 16 are never actually transmitted to outside of the case 12.

When the speaker 10 is in use, it is arranged so that the opening of the case 12 is located on the floor, support surface or mounting surface 50 such that the speaker unit 16 faces the floor, support surface or mounting surface 50 and fires sound waves directly toward the floor, support surface or mounting surface 50. Therefore, since the sound emitted from the front surface of the speaker unit 16 is emitted into a space which is closed off by the floor and the case 12, the sound does not escape to outside of the case 12. That is, since the speaker unit 16 does not directly emit sound to the outside, unwanted directional sound pressure is eliminated. In this speaker 10, the back-and-forth vibration of the vibrator of the speaker unit 16 applies pressure to the air inside of the case 12, and this pressure causes the case 12 to expand and contract. As a result of this expansion and contraction of the case 12, spherical waves are emitted outside of the case by vibration of the case. case 12 by the vibration of the case.

In the speaker 10, the back-and-forth vibration of the vibrator of the speaker unit 16 expands and contracts the case 12, and consequently, non-directional spherical waves, which are ideal speaker waves, are emitted to the outside of the case 12. As a result, the speaker 10 using a case 12 having width, depth and height of, for example, about 10 cm, as shown in FIG. 1, is able to generate very low-frequency tones, enabling the speaker 10 to be used as a woofer. Thus, it is possible to realize a speaker which has a very small size and has a non-directional sound wave transmittance in comparison to the conventional speaker.

Furthermore, the expansion and contraction of the case 12 increases the resonant frequency of the speaker 10. A speaker has poor fidelity of signal reproduction at frequencies higher than the resonant frequency, and when a signal at a frequency higher than the resonant frequency is input, the motion of the vibrator will lag behind the input signal. Consequently, there is a disadvantage that sounds at frequencies higher than the resonant frequency cannot be generated faithfully. However, the speaker 10 of preferred embodiments of the present invention has a higher resonant frequency than a speaker using sound obtained directly from a speaker unit, and therefore its fidelity of reproduction of input signals is greatly improved.

To enable the case 12 of the speaker 10 to expand and contract, the case 12 has a structure which does not restrict its expansion and contraction. For instance, no case reinforcing member or sound-absorbing material or the like is provided inside of the case 12. Actually, a case reinforcing member or sound-absorbing material or the like may be provided inside of the case 12 in order to adjust the amount of expansion and contraction of the case 12, but it is preferable that such members do not obstruct the expansion and contraction of the case 12. That is, such reinforcing or absorbing members should be arranged to not affect or distort the expansion and contraction of the case.

Figure 3:
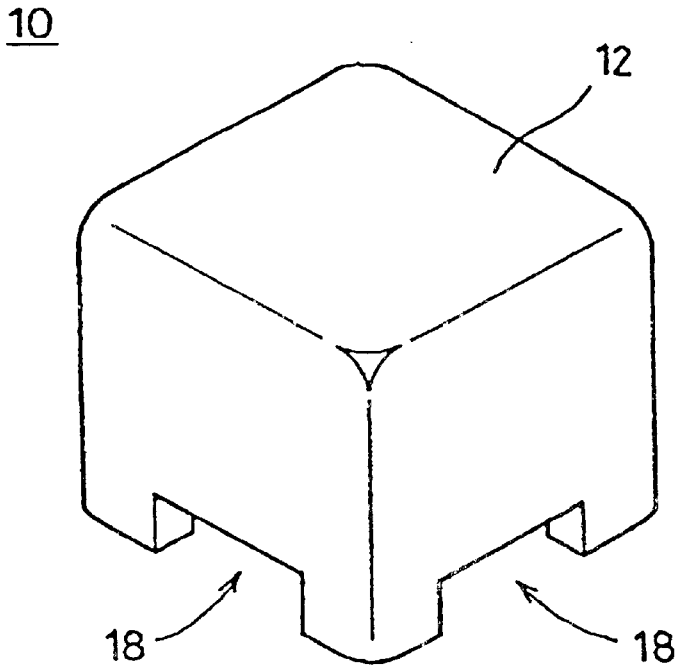
FIG. 3 is a perspective view of a modified example of the speaker of FIG. 1.

As shown in FIG. 3, ports 18 may be provided at the bottom surface of the case 12, that is, on the surface of the case that is disposed in contact with the floor or mounting surface. Any number of ports 18 may be provided and may be located, for example, on the four lower side surfaces of the case 12. These ports 18 are used to transmit sound emitted from the front surface of the speaker unit 16 to the outside thereof, thereby accentuating the low-frequency tones. When the ports 18 are provided in the four surfaces of the case 12, low-frequency tones are emitted around the speaker 10, hence the speaker 10 is non-directional. Since human perception of low audio frequencies does not have directivity, the speaker can be made perceptually non-directional by providing a port 18 in just one side surface of the case 12.

Figure 4:
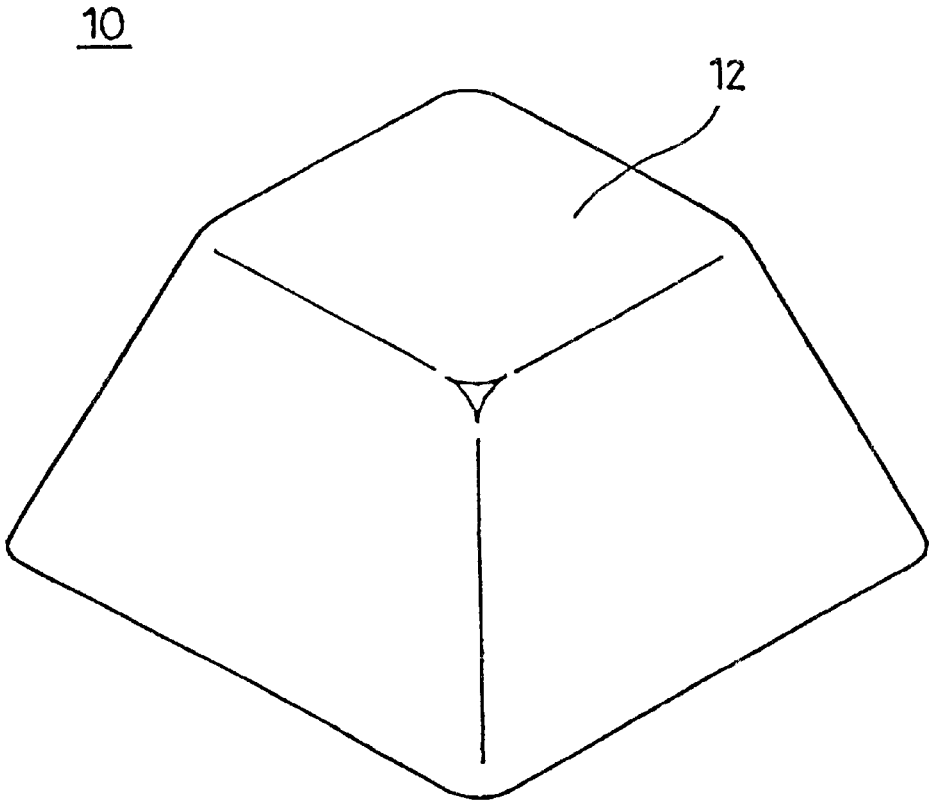
FIG. 4 is a perspective view of another example of a speaker of the present invention.

The material of the case 12 is not limited to wood, and rubber, plastic, resin, ceramic, glass, metal and the like can be used, depending on the desired frequency. Furthermore, the shape of the case 12 may be a truncated pyramid as shown in FIG. 4, or the case 12 may have a shape such as a pyramid, a cone, a truncated cone, a dome or other suitable shape. In addition, to accentuate the low-frequency tones, a small port may be arranged to extend from the airtight space of the case 12 and to open to the outside, but it is more preferable that the inside of the case 12 is an airtight space, so that the back-and-forth vibration of the vibrator of the speaker unit 16 is able to expand and contract the case 12.

Figure 5:
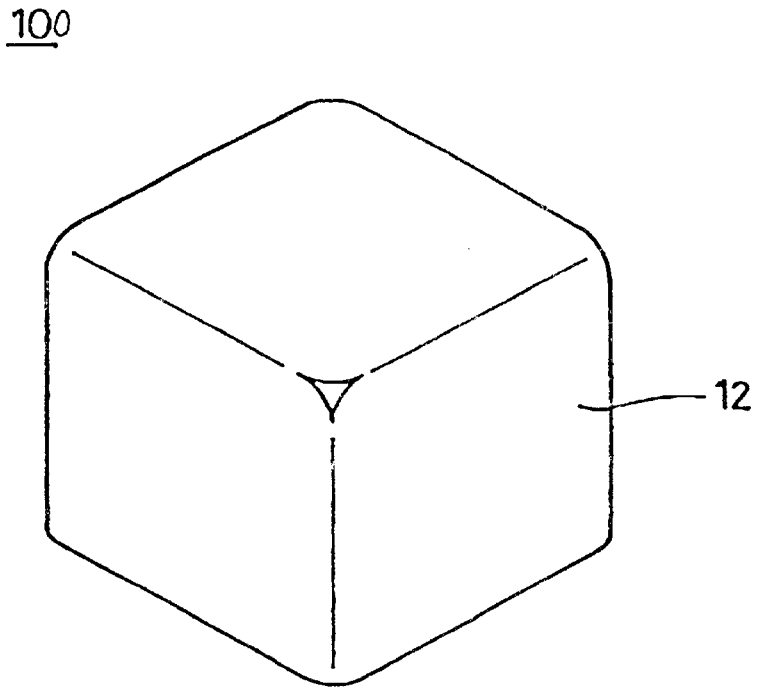
FIG. 5 is a perspective view of an example of a speaker device of the present invention.

FIG. 5 is a perspective view of an example of a speaker device of a preferred embodiment of the present invention. The speaker device 100 includes a case 12. The case 12 may be approximately cubic or have any of the shapes described above. In the speaker device 100 shown in FIG. 5, the case 12 is preferably not a perfect cube, since the ridge portions of the cube are rounded so that the intersections between all of the flat faces are curved. The case 12 can be made of any of the materials mentioned above.

Figure 6:
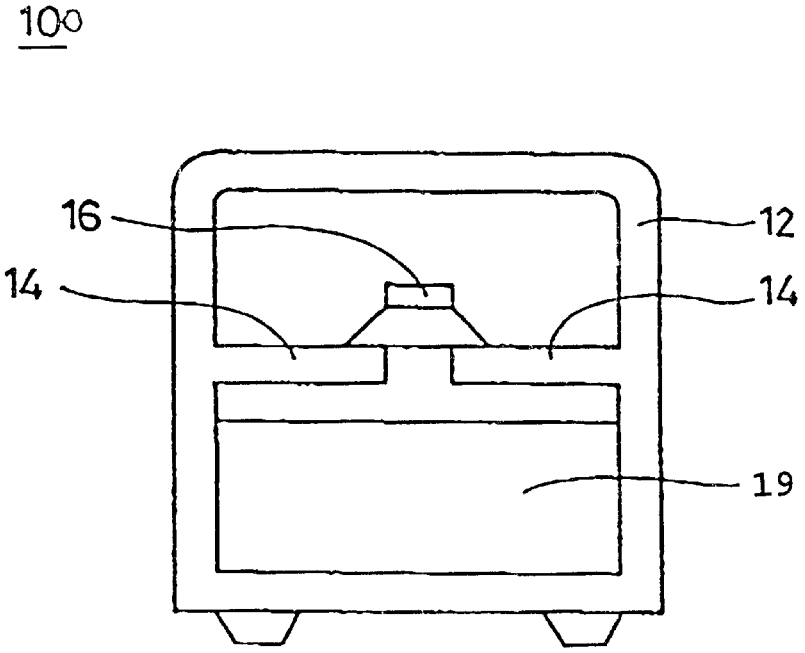
FIG. 6 is a cross-sectional diagrammatic view of the speaker device of FIG. 5.

As shown in FIG. 6, a plate 14 has a through hole provided therein and is provided approximately in the middle of the case 12. A speaker unit 16 is attached at the through hole at the approximate center of the plate 14. A dynamic speaker unit can, for instance, be used as the speaker unit 16. Furthermore, an amplifier main body 19 is provided at the front of the speaker unit 16. Therefore, the case 12, the plate 14 and the speaker unit 16 define two airtight spaces. The amplifier main body 19 is provided in the airtight space in front of the speaker unit 16. The speaker unit 16 and the amplifier main body 19 are preferably connected together via wiring inside the case 12.

When the speaker device 100 is used, the speaker device 100 is mounted such that the amplifier main body 19 faces and is located closest to the floor or mounting surface on which the speaker device is supported. In the speaker device 100, sound is emitted from the front surface of the speaker unit 16 into the airtight space where the amplifier main body 19 is provided. The weight of the amplifier main body 19 restricts unwanted vibrations so that the sound does not escape outside of the case 12, thereby eliminating unwanted directional sound pressure. In the speaker device 100, the back-and-forth vibration of the vibrator of the speaker unit 16 applies pressure to the air inside of the case 12, and this pressure expands and contracts the case 12. As a result of this expansion and contraction of the case 12, spherical waves are emitted outside of the case 12.

According to the speaker device 100, the back-and-forth vibration of the vibrator of the speaker unit 16 expands and contracts the case 12, and consequently non-directional spherical waves, which are ideal speaker waves, can be emitted to the outside of the case 12. As a result, the speaker device 100 using a case 12 as shown in FIG. 5, generates low-frequency tones, enabling the speaker device 100 to be used as a woofer. Thus, by combining the case 12 and the speaker unit 16, it is possible to provide a speaker which has a very small size and transmits waves in a non-directional manner compared to the conventional audio device.

Furthermore, the expansion and contraction of the case 12 significantly increases the speaker-resonant frequency of the speaker device 100. A speaker has poor fidelity of signal reproduction at frequencies higher than the resonant frequency, and when a signal at a frequency higher than the resonant frequency is input, the motion of the vibrator will lag behind the input signal. Consequently, there is a disadvantage that sounds at frequencies higher than the resonant frequency cannot be generated faithfully. However, the speaker device 100 of preferred embodiments of the present invention has a higher resonant frequency than a speaker using sound obtained directly from a speaker unit, and therefore its fidelity in reproducing input signals is greatly improved.

To allow the case 12 of the speaker device 100 to expand and contract, the case 12 has a structure which does not restrict its expansion and contraction and which allows for full and free vibration of the case 12. For instance, no case reinforcing member or sound-absorbing material or the like is provided inside of the case 12. Actually, a case reinforcing member or sound-absorbing material or the like may be provided inside of the case 12 in order to adjust the level of expansion and contraction of the case 12, but it is preferable that such members do not affect or obstruct the expansion and contraction of the case 12.

Furthermore, in the speaker device 100, since the speaker unit 16 and the amplifier main body 19 are wired together inside the case 12, external wires are not required, enabling the installation area to be reduced. In addition, internal wiring makes it possible to shorten the lengths of the wires between the speaker unit 16 and the amplifier main body 19, reducing electrical loss. Furthermore, the number of components such as connection terminals can be reduced, enabling the speaker device 100 to have a very small size.

Figure 7:
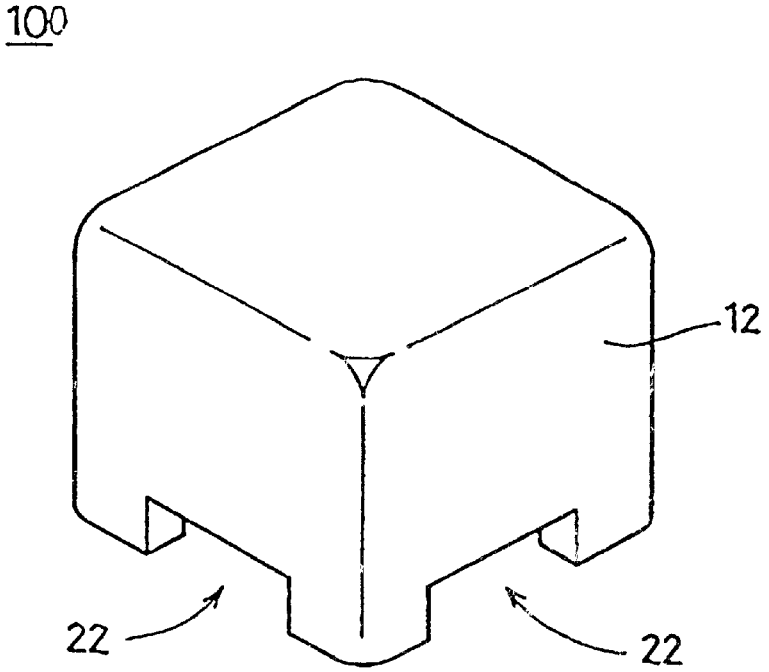
FIG. 7 is a perspective view of a modified example of the speaker device of FIG. 5.
Figure 8:
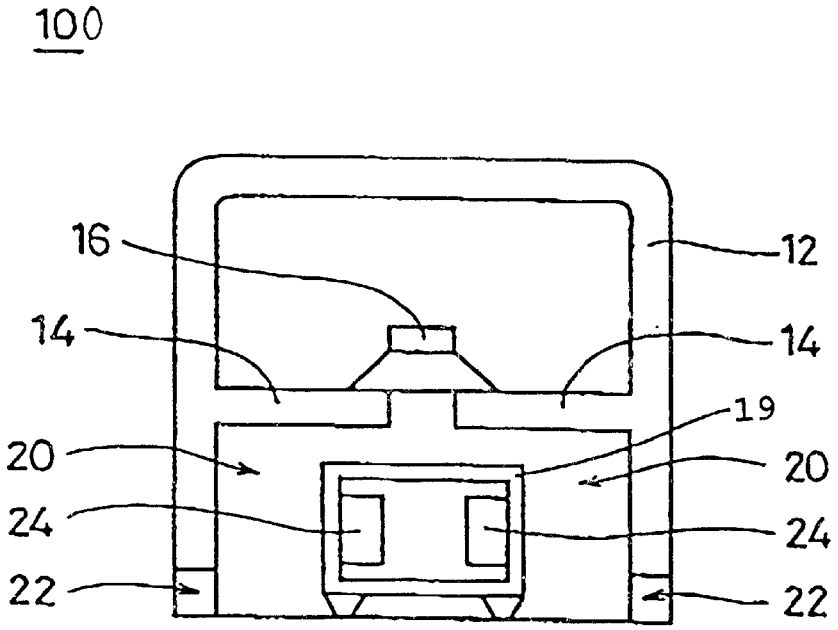
FIG. 8 is a cross-sectional diagrammatic view of the speaker device of FIG. 7.

As shown in FIG. 7 and FIG. 8, a gap 20 may be provided between the wall of the case 12 and the amplifier main body 19. The gap 20 leads to the outside through openings 22 in the floor-contacting portions of the case 12. In the speaker device 100, components 24 of the amplifier main body 19 which generate heat are provided at locations of the gap 20. Therefore, the back-and-forth vibration of the vibrator of the speaker unit 16 sends the air inside of the case 12 through the gap 20, and the air flows along the outer sides of the amplifier main body 19. This captures the heat generated by the heat-generating components 24 which face the air flow, thereby cooling the amplifier main body 19. In this case, when a loud sound is emitted, the amplifier main body 19 generates a large amount of heat, but the amplitude of the vibrator of the speaker unit 16 also increases, increasing the amount of air passing through the gap 20, thereby increasing the cooling effect. That is, the cooling effect increases in correspondence with the amount of heat generated by the amplifier main body 19, ensuring efficient cooling.

Furthermore, since the sound emitted from the front surface of the speaker unit 16 passes through the gap 20 and is transmitted to outside of the speaker, the gap 20 functions as a load horn. This load horn is arranged to accentuate the low-frequency tones. The load horn including the gap 20 can be made non-directional by emitting sound from four openings 22 of the case 12. However, since human perception of low audio frequencies does not have directivity, the speaker can be made perceptually non-directional even when an opening 22 is provided in just one side surface of the case 12.

Figure 9:
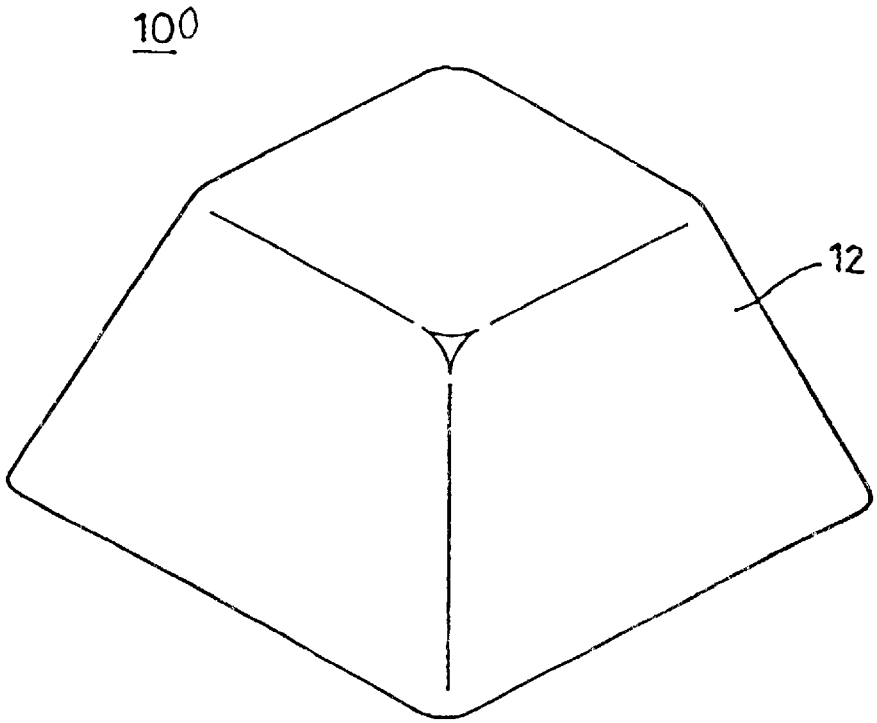
FIG. 9 is a perspective view of another example of a preferred embodiment of the speaker device of the present invention.
Figure 10:
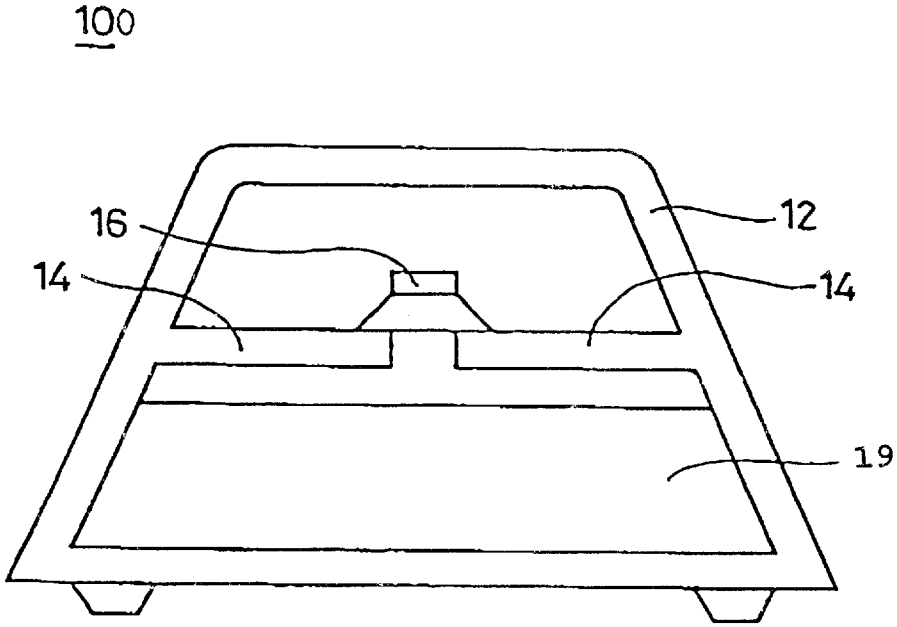
FIG. 10 is a cross-sectional diagrammatic view of the speaker device of FIG. 9.
Figure 11:
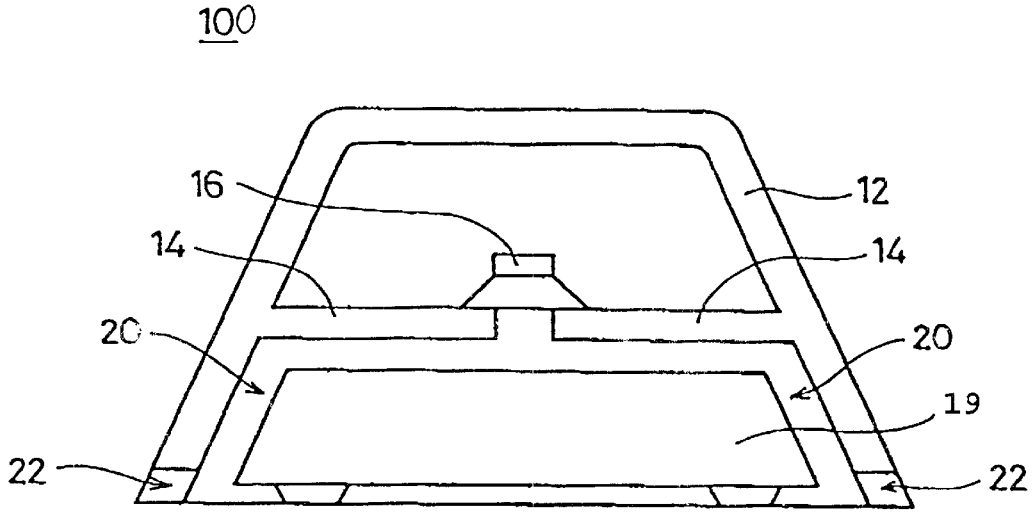
FIG. 11 is a cross-sectional diagrammatic view of a modified example of the speaker device of FIG. 9.
Figure 12:
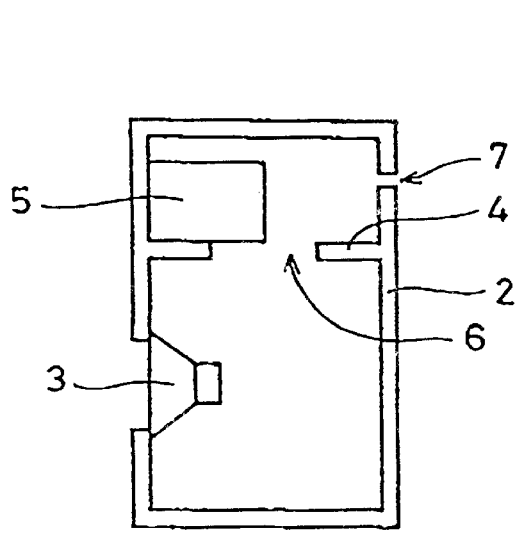
Fig. 12 PRIOR ART
FIG. 12 is a diagrammatic view of an example of an audio device relevant to the background of the present invention.

Alternatively, as shown in FIG. 9 and FIG. 10, the case 12 may be a truncated pyramid. Here too, the speaker can have a very small size by using the expansion and contraction of the case of the amplifier, as in the speaker device shown in FIG. 5. Therefore, it is possible to obtain a very small speaker device having a non-directional speaker. Furthermore, as shown in FIG. 11, when a gap 20 is provided between the walls of the case 12 and the amplifier main body 19 of a speaker device 100 using a truncated pyramid-like case 12, both effects of cooling the amplifier main body 19 and functioning as a load horn to accentuate the low tones are achieved.

The material of the case 12 is not limited to wood, and rubber, plastic, resin, ceramic, glass, metal and the alike can be used, depending on the desired frequency. Furthermore, the case 12 may have any shape such as a pyramid, a cone, a truncated cone, a dome or others. In addition, to accentuate the low-frequency tone portion, a small port extending from the airtight space of the case 12 and opening to the outside is provided. However, it is more preferable that the inside of the case 12 is airtight, so that the back-and-forth vibration of the vibrator of the speaker unit 16 causes the case 12 to expand and contract.

According to preferred embodiments of the present invention, it is possible to provide a very small size, non-directional speaker generating non-direction spherical waves, which are ideal speaker waves. Since sound is emitted by expansion and contraction of the case, rather than directly from the speaker unit, the sound pressure does not increase even when loud sound is emitted, enabling a pleasant sound to be obtained. Furthermore, the resonant frequency of the speaker is greatly increased, thereby improving its fidelity of reproduction of input signals.

The present invention uses the expansion and contraction of the case of an amplifier to obtain spherical waves, which are ideal for a speaker. Therefore, by providing the speaker unit inside of the case of the amplifier, it is possible to obtain a speaker device having a very small size and non-directional wave transmittance. Furthermore, when the speaker unit is provided inside of the case and a gap is provided between the walls of the case and the amplifier main body, the flow of air through the gap is able to effectively cool the amplifier main body, and in addition, low-frequency tones are greatly accentuated. Since the sound is emitted by expansion and contraction of the case, rather than directly from the speaker unit, the sound pressure does not increase even when loud sound is emitted, enabling a pleasant sound to be obtained. Furthermore, the resonant frequency of the speaker of the speaker device is increased significantly thereby improving its fidelity of sound reproduction of input signals.

While preferred embodiments of the invention have been disclosed, various modes of carrying out the principles disclosed herein are contemplated as being within the scope of the following claims. Therefore, it is understood that the scope of the invention is not to be limited except as otherwise set forth in the claims.

What is claimed is:

1. A speaker device, comprising:

a speaker unit;

a case attached to the speaker unit; wherein said speaker unit and said case are arranged such that the case vibrates in response to vibration of the speaker unit and the only sound emitted from the speaker is the sound generated by the vibration of the case, the sound generated by the vibration of the case is emitted substantially evenly from all portions of the case such that non-directional spherical sound waves are emitted from substantially an entire outer surface of the case.

2. The speaker according to claim 1, wherein said speaker unit is arranged to face a mounting surface on which the case is provided.

3. The speaker according to claim 1, wherein a space inside of the case which is defined by the speaker unit and inner surfaces of the case, is airtight such that sound waves transmitted from the speaker unit are not transmitted to outside of the case but generate the vibration of the case.

4. The speaker according to claim 1, further comprising a port provided at a lower portion of the case and located near a mounting surface on which the case is supported.

5. The speaker according to claim 1, wherein the inner portion of the case is arranged to allow for free vibration of the case.

6. The speaker according to claim 1, wherein a rear surface of the speaker unit is arranged to be farther away from a surface upon which the speaker is mounted than a front surface of the speaker unit from which sound waves are transmitted.

7. The speaker according to claim 1, wherein the speaker is supported on a mounting surface, and a plate is provided inside of the case, the speaker unit being mounted on the plate, and the speaker unit, the plate, and the mounting surface are arranged such that an airtight chamber is defined therebetween so as to prevent sound waves emitted from the speaker unit from being transmitted to outside of the case.

8. The speaker according to claim 1, wherein the case is made of at least one of wood, rubber, plastic, resin, ceramic, glass, and metal.

9. The speaker according to claim 1, wherein the case has a shape that is one of cubic, rounded cubic, square, triangular, truncated pyramid and rectangular.

10. A speaker device, comprising:

a case;

an amplifier main body stored inside of the case; and a speaker unit stored inside of the case having a front surface; wherein the amplifier main body is located directly in front of the speaker unit such that the amplifier main body blocks the entire sound emitting surface of the speaker unit.

11. The speaker device according to claim 10, wherein the speaker device is mounted on a support surface, the amplifier main body is located closer to the support surface that the speaker unit and the speaker unit faces toward the support surface so as to emit sounds through the amplifier main body.

12. The speaker device according to claim 10, wherein a gap is provided between inner wall surfaces of the case and the amplifier main body such that air generated by the vibration of the speaker unit passes through the gap to cool the interior of the case, and the gap is arranged to define a load horn for making the sound emitted from the speaker unit pass therethrough.

13. A speaker device according to claim 10, wherein vibration of the speaker unit causes the case to vibrate such that the only sound waves emitted from the speaker unit are generated by the vibration of the case.

14. A speaker device according to claim 10, wherein the inner portion of the case is arranged to allow for free vibration of the case.

15. The speaker according to claim 10, wherein said speaker unit is arranged to face a mounting surface on which the case is provided.

16. The speaker according to claim 10, wherein a space inside of the case which is defined by the speaker unit and inner surfaces of the case, is airtight such that sound waves transmitted from the speaker unit are not transmitted to outside of the case but generate the vibration of the case.

17. The speaker according to claim 16, further comprising two of the airtight spaces, one of the airtight spaces including the speaker unit and the other of the airtight spaces including the amplifier main body.

18. The speaker according to claim 10, further comprising a port provided at a lower portion of the case and located near a mounting surface on which the case is supported.

19. The speaker according to claim 10, wherein a rear surface of the speaker unit is arranged to be farther away from a surface upon which the speaker is mounted than a front surface of the speaker unit from which sound waves are transmitted.

20. The speaker according to claim 10, wherein the speaker is supported on a mounting surface, and a plate is provided inside of the case, the speaker unit being mounted on the plate, and the speaker unit, the plate, and the mounting surface are arranged such that an airtight chamber is defined therebetween so as to prevent sound waves emitted from the speaker unit from being transmitted to outside of the case.

* * * * *